United States Patent [19]

Sheldon

[11] 4,145,855

[45] Mar. 27, 1979

[54] SYSTEM FOR PROTECTING AN ENCLOSED SPACE FROM HIGH OR LOW TEMPERATURE EXTREMES

[76] Inventor: Robert T. Sheldon, P.O. Box 486, DeLeon Springs, Fla. 32028

[21] Appl. No.: 913,503

[22] Filed: Jun. 7, 1978

Related U.S. Application Data

[63] Continuation of Ser. No. 794,986, May 9, 1977, abandoned.

[51] Int. Cl.[2] ..... E04C 2/00; E04H 1/12

[52] U.S. Cl. ..... 52/232; 52/79.6; 52/660; 52/DIG. 12; 427/155; 427/156; 427/388 C; 427/247; 428/255; 428/256

[58] Field of Search ..... 52/202, 203, DIG. 12, 52/79.6, 232, 348, 660; 106/197 R; 428/255, 256; 427/156, 155, 388 C, 247, 243

[56] References Cited

U.S. PATENT DOCUMENTS

| | | | |
|---|---|---|---|
| 643,594 | 2/1900 | Crowell | 428/255 |
| 1,746,625 | 2/1930 | White | 52/232 |
| 2,069,268 | 2/1937 | Otto | 52/202 |
| 2,566,067 | 8/1951 | McKinley et al. | 52/202 |
| 2,883,712 | 4/1959 | Shelamer, Sr. | 52/79.6 |
| 3,004,592 | 10/1961 | Norton | 160/114 |
| 3,114,650 | 12/1963 | Oppenheim et al. | 427/155 X |
| 3,478,805 | 11/1969 | Haggard | 160/84 R |
| 3,480,069 | 11/1969 | Handwerker | 52/DIG. 12 |
| 3,677,014 | 7/1972 | Stout et al. | 61/36 C X |
| 3,696,498 | 10/1972 | Leontaritis | 427/156 |
| 3,709,876 | 1/1973 | Glomski et al. | 106/197 R X |
| 3,922,395 | 11/1975 | Smith | 427/247 |
| 3,927,496 | 12/1975 | Kersavage | 52/80 |
| 3,939,662 | 2/1976 | Volz | 61/36 C X |

FOREIGN PATENT DOCUMENTS

| | | | |
|---|---|---|---|
| 420250 | 11/1934 | United Kingdom | 427/156 |

*Primary Examiner*—Leslie Braun

[57] ABSTRACT

A system for protecting an enclosed space from the effects of above- and below-normal temperatures comprises means defining an enclosed space including at least one relatively large opening, a screen-like cover over said opening containing numerous smaller openings which have been closed over with a water-removable composition comprising a water soluble, heat transfer resistant organic polymeric coating.

10 Claims, 2 Drawing Figures

SYSTEM FOR PROTECTING AN ENCLOSED SPACE FROM HIGH OR LOW TEMPERATURE EXTREMES

This is a continuation, of application Ser. No. 794,986 filed May 9, 1977 now abandoned.

The present invention relates to a system for protecting enclosed spaces, such as houses, carports, porches, and the like, from damage by over-heating or by frost and freezing. More particularly, it concerns a system comprising one or more covers on the openings in such spaces, the covers containing a number of smaller openings substantially all of which have been sealed with a water-removable, heat loss retarding coating.

BACKGROUND OF THE INVENTION

Enclosed spaces in the Northern climates, especially, need protection against heat loss during cold weather if they are to remain habitable, and to prevent freeze damage to their contents. Also, too high temperatures can cause damage and discomfort. Protection can be accomplished by using windows and double glazing, storm doors, heat shields, and the like, but this is expensive. Since screens usually are used in the summer, it would be beneficial to adapt them to use in the winter to prevent frost and freeze damage, and to increase their efficiency as insulators in hot weather. It would also be advantageous to provide a way of providing protection against temperature extremes which could be modified, e.g., to screen out insects, or to provide some degree of sun-shading yet permit the passage of summer breezes and the like, if desirable.

A system to protect enclosures against temperature extremes has not been discovered which eliminates the need to use continuous sheets or panes and which cuts down substantially the need for interior heaters and coolers. In essence, a water-removable film with heat loss retarding capability is applied to a screen-like cover placed over openings in the enclosure. The film bridges over the normally present smaller openings in the cover to keep out the above- and beloww-normal temperatures, e.g., by preventing or retarding heat and cold air loss. It is a feature of the discovery to permit the film to be washed off with water after danger of hot and/or cold weather has passed, restoring the openings in the cover. The invention can also be used in conjunction with single pane windows, for example, to provide a dead air space between the cover and the windows, to substantially reduce the loss of cold air or of heat to the outside.

BRIEF DESCRIPTION OF THE DRAWING

The drawing illustrates one preferred embodiment of the invention.

DESCRIPTION OF THE INVENTION

Figure 1:
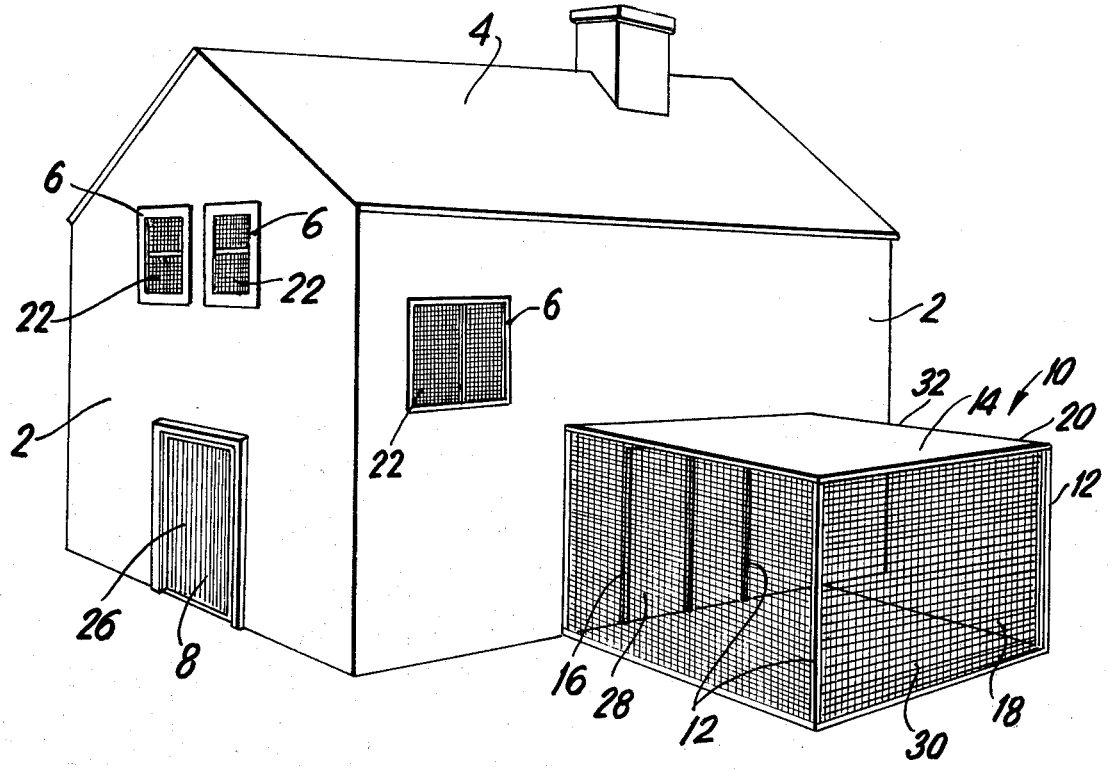
FIG. 1 shows a dwelling in which openings comprising windows, a door and a porch are covered with screen-like sheets coated with a water-soluble coating material.

In accordance with this invention, there is provided a system for protecting an enclosed space from the effects of temperature extremes comprising:

means for defining an enclosed space including at least one opening large enough to permit temperature losses from the interior to the exterior whereby an above- or below-normal interior temperature is produced;

a screen-like cover over each said opening comprising a material containing a multiplicity of smaller openings; and a heat transfer resistant, water-removable coating on said cover in an amount at least sufficient to form a continuous film by bridging the openings therein.

Optional, preferred features comprise systems in which the water soluble coating is translucent to permit light to pass therethrough; the coating comprises a natural or synthetic organic polymeric substance; the openings also include panes of sheetlike material to form a dead air space with the filmed-over screen; and the enclosed space comprises a house, including a door, and/or at least one window, or the enclosure is a porch, and the like.

The cover can be embodied in the enclosure by a number of means. For example, one or more uprights can be used to frame an opening for the sheet-like cover. On the other hand, a conventional house can include windows and doors over which the screen-like cover is fixed. Or a rigid frame can be constructed, the cover fastened at its edges around the frame and the frame itself held in an opening. Obviously, many other means for using sheet-like covers for openings in enclosures will suggest themselves to those skilled in this art without departing from the spirit of the invention.

In any event, the cover will have a multitude of smaller openings. The cover can be of metal screening or plastic screening of the type of common knowledge and experience. The materials known as plastic shade cloth and as window screening are very useful for this purpose.

The film-forming coating for the cover can vary in type, so long as it is water-soluble and capable of bridging the openings to provide a temporary closed film. It can be natural or synthetic in nature, e.g., a thick starch, or a modified dextrin or a cellulose derivative, e.g., methyl cellulose, or it can be a poly(vinyl alcohol).

The coating can be applied in a number of ways, e.g., by dip and/or roller coating, or brushing, and the like. However, in a preferred embodiment, the coating will be applied by use of a water solution and then permitting the water to evaporate. In one convenient way, the coating will be applied by painting with a brush or by spraying a water solution onto the cover, and allowing the water to evaporate. If the coating is thick enough, foaming agents can be included to decrease its density and to provide cells which enhance thermal insulation capability.

The coating should be removable by spraying with water. The system used to apply to coating can be adapted to spray water to remove the coating when desired.

DESCRIPTION OF A PREFERRED EMBODIMENT

The drawing aids in understanding the invention but the claims are not to be construed as being limited to the system illustrated therein. Referring to the drawing, a space is enclosed by a system of walls 2 and covered by roof 4. In the walls are a number of openings for windows 6 and door 8. Also shown is screen porch 10 comprising uprights 12 and flat roof 14. Windows 6 and door 8 as well as the openings 16, 18 and 20 framed by uprights 12, roof 14 and wall 2 have stretched thereover screen-like covers 22, 24, 26, 28, 30 and 32, respectively.

Figure 2:
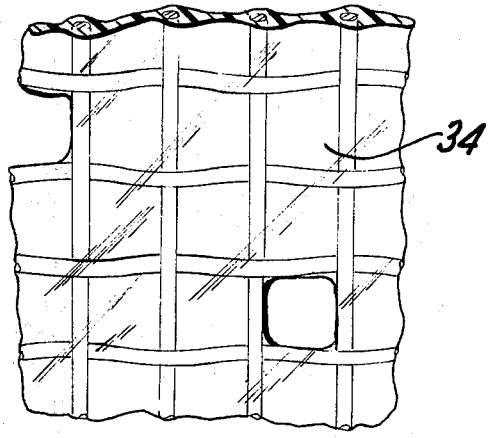
FIG. 2 is an enlarged portion of a screen coated with a film of material.

These screen-like covers have a polymeric film thereover, such as is shown in the magnified view, FIG. 2.

The coating film 34 can be transluscent, e.g., a dextrin coating or a methyl cellulose coating, or a poly(vinyl alcohol) and the like. This permits light to pass through, and thus avoids interfering with occupation by people within the structure.

One means for applying and removing coating 34 from the sheet-like cover is as follows:

Dissolve 4 ounces of methyl cellulose (METHOCEL, K4MS, Dow Chemical Company, Midland, Michigan, or an obvious chemical equivalant) in water by feeding slowly into an agitated gallon of water. Then "paint" the composition with a brush onto 300 square feet of window screening enclosing the openings in a typical dwelling. When the water evaporates, approximately 99 of each 100 openings in the mesh screens are covered with a transluscent, heat loss resistant, coating.

Washing with water, as from a hose, readily removes the coating, leaving the screens open to the passage of heat.

It can be seen from the above-detailed description that this invention provides a number of substantial benefits. A further extension of the invention is to use the coated screen in combination with panes, e.g., of glass to provide a dead air space between them. This provides superior resistance to heat loss.

All obvious modifications are contemplated by the appended claims.

I claim:

1. A system for protecting an enclosed space from the effects of temperature extremes while such extremes prevail and for removing such protection after such extremes pass comprising:

means defining an enclosed space including at least one opening large enough to permit temperature losses from the interior whereby above- and below-normal temperatures are produced;

a screen-like cover over said opening comprising a material containing a multiplicity of smaller openings; and a heat transfer resistant, water-removable coating on said cover in an amount at least sufficient to form a continuous bridge over the openings therein whereby the enclosed space is protected from the effects of temperature extremes while such coating bridges said openings and the interior of said enclosure is vented to the exterior by removing said bridging coating from said openings with water after said temperature extreme passes.

2. A system as defined in claim 1 wherein said enclosed space is a house for human habitation and said opening comprises a door.

3. A system as defined in claim 2 which also includes at least one window as said opening.

4. A system as defined in claim 1 wherein said enclosed space is a porch on a house.

5. A system as defined in claim 1 wherein said opening is covered at least in part by an imperforate sheetlike pane and said screen-like cover is spaced apart from said imperforate pane so as to form a dead air space therebetween.

6. A system as defined in claim 5 wherein said imperforate sheet-like pane comprises glass.

7. A system as defined in claim 1 wherein said coating is transluscent to permit light to pass therethrough

8. A system as defined in claim 1 wherein said coating is the product of in situ evaporation of water from an aqueous medium containing a natural or synthetic organic polymeric substance.

9. A system as defined in claim 8 wherein said organic polymeric substance is methyl cellulose.

10. A system as defined in claim 8 wherein said organic polymeric substance is poly(vinyl alcohol).

* * * * *